US012460502B2

(12) United States Patent
Carrillo et al.

(10) Patent No.: US 12,460,502 B2
(45) Date of Patent: Nov. 4, 2025

(54) WIRELINE DYNAMIC SEALING PACKER

(71) Applicant: Schlumberger Technology Corporation, Sugar Land, TX (US)

(72) Inventors: Kody Carrillo, Sugar Land, TX (US); Ian McDaniel, Sugar Land, TX (US); Taylor Mozisek, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/725,379

(22) PCT Filed: Feb. 27, 2023

(86) PCT No.: PCT/US2023/063311

§ 371 (c)(1),
(2) Date: Jun. 28, 2024

(87) PCT Pub. No.: WO2023/168198

PCT Pub. Date: Sep. 7, 2023

(65) Prior Publication Data

US 2025/0163769 A1 May 22, 2025

Related U.S. Application Data

(60) Provisional application No. 63/315,603, filed on Mar. 2, 2022.

(51) Int. Cl.

| | |
|---|---|
| ***E21B 33/12*** | (2006.01) |
| ***E21B 33/072*** | (2006.01) |
| ***E21B 33/08*** | (2006.01) |

(52) U.S. Cl.
CPC ..... *E21B 33/1208* (2013.01); *E21B 33/072* (2013.01); *E21B 33/08* (2013.01)

(58) Field of Classification Search
CPC ..... E21B 33/072; E21B 33/08
See application file for complete search history.

(56) References Cited

U.S. PATENT DOCUMENTS 1,875,936 A * 9/1932 Saunders ..... E21B 33/08 277/330
2,258,887 A * 10/1941 Fortune ..... F16J 15/183 277/517

(Continued)

FOREIGN PATENT DOCUMENTS

CA 2708851 C 4/2014
CN 207974789 U 10/2018

(Continued)

OTHER PUBLICATIONS

Oxford Languages. (2025). Flat. Retrieved from https://www.google.com on May 1, 2025. (Year: 2025).*

(Continued)

*Primary Examiner* — Robert E Fuller
(74) *Attorney, Agent, or Firm* — Jeffrey D. Frantz

(57) ABSTRACT

A packer includes a cylinder of elastomer including: two flat ends, a longitudinal axis, an opening formed along the longitudinal axis, the opening configured to accommodate a cable, and at least one contact pressure feature running around a circumference of the cylinder. The cylinder is split perpendicular to the flat ends into two halves.

16 Claims, 7 Drawing Sheets

(56) References Cited

U.S. PATENT DOCUMENTS

| | | | | | |
|---|---|---|---|---|---|
| 2,943,682 | A * | 7/1960 | Ingram, Jr. | E21B 33/072 | 166/77.1 |
| 2,968,500 | A | 1/1961 | Scaramucci | | |
| 2,968,505 | A * | 1/1961 | Scaramucci | E21B 33/08 | 277/330 |
| 3,132,867 | A * | 5/1964 | Scaramucci | E21B 33/08 | 277/330 |
| 3,145,995 | A * | 8/1964 | Adamson | E21B 33/072 | 277/330 |
| 3,168,320 | A * | 2/1965 | Sneed | F16J 15/20 | 277/540 |
| 3,228,703 | A * | 1/1966 | Wilson | E21B 33/08 | 277/330 |
| 3,265,399 | A * | 8/1966 | Scaramucci | E21B 33/08 | 277/330 |
| 3,637,009 | A | 1/1972 | James | | |
| 4,423,775 | A * | 1/1984 | Wilson | E21B 33/08 | 277/330 |
| 5,579,839 | A | 12/1996 | Culpepper | | |
| 5,676,384 | A | 10/1997 | Culpepper | | |
| 7,331,393 | B1 | 2/2008 | Hoel | | |
| 8,443,878 | B2 | 5/2013 | McCollin | | |
| 8,863,830 | B2 * | 10/2014 | Varkey | E21B 33/068 | 166/77.1 |
| 9,140,115 | B2 | 9/2015 | Varkey | | |
| 9,556,700 | B2 | 1/2017 | Shek | | |
| 10,487,616 | B2 | 11/2019 | Varkey | | |
| 10,526,863 | B2 | 1/2020 | Gabriele | | |
| 10,683,934 | B2 | 6/2020 | Arteaga | | |
| 10,968,715 | B2 | 4/2021 | McDaniel | | |
| 11,137,109 | B2 | 10/2021 | Babineaux | | |
| 2009/0183881 | A1 | 7/2009 | Sbordone | | |
| 2010/0258323 | A1 | 10/2010 | Varkey | | |
| 2011/0011593 | A1 | 1/2011 | Borhaug | | |
| 2011/0094731 | A1 | 4/2011 | Crawford | | |
| 2011/0192610 | A1 | 8/2011 | Machin | | |
| 2012/0024521 | A1 | 2/2012 | Villa | | |
| 2012/0292051 | A1 | 11/2012 | Wetzel | | |
| 2013/0140042 | A1 * | 6/2013 | Benson | E21B 33/04 | 166/387 |
| 2013/0161019 | A1 | 6/2013 | Organ | | |
| 2020/0309265 | A1 | 10/2020 | Arteaga | | |
| 2025/0012163 | A1 | 1/2025 | Caekebeke | | |

FOREIGN PATENT DOCUMENTS

| | | | | |
|---|---|---|---|---|
| FR | 2466684 | A1 * | 4/1981 | F16J 15/20 |
| GB | 2433283 | A | 6/2007 | |
| WO | 2009074780 | A2 | 6/2009 | |
| WO | 2024072770 | A1 | 4/2024 | |
| WO | 2024072776 | A1 | 4/2024 | |
| WO | 2024123587 | A1 | 6/2024 | |

OTHER PUBLICATIONS

Non Final Office Action and 892 of U.S. Appl. No. 18/347,941 dated on Sep. 30, 2024; 9 Pages.

International Search Report and Written Opinion issued in International Patent Appl. No. PCT/US2023/063311 on Jun. 23, 2023; 9 pages.

Combined Search and Exam Report issued in Great Britain Patent Application No. GB2409782.6 dated Dec. 31, 2024, 5 pages.

* cited by examiner

WIRELINE DYNAMIC SEALING PACKER

CROSS-REFERENCE TO RELATED APPLICATION

This application is a National Stage Entry of International Application No. PCT/US2023/063311, filed Feb. 27, 2023, which claims priority to and the benefit of U.S. Provisional Application No. 63/315,603, filed Mar. 2, 2022, is incorporated by reference herein in its entirety.

BACKGROUND

Pressure control equipment ("PCE") provides an interface for drilling and intervention into high pressure wells. During intervention, PCE provides a dynamic sealed communication conduit that allows various downhole tools access to the well without allowing the pressurized contents of the well to escape.

As a tool is run into or removed from a well, a cable or length of tubing connects the tool to a control winch or reel. This cable or tubing may move at a high rate of speed. The seal formed around this cable or tubing is often the point most likely to leak well contents. The leak could be due to interaction of the cable or tubing with the seal, or a breakdown of the seal itself. The design of the seal is critical to the function of the PCE. Accordingly, there is a need for an improved method for sealing around a cable or tubing in a pressure control device mounted on a pressurized well.

SUMMARY

A packer includes a cylinder of elastomer including: two flat ends, a longitudinal axis, an opening formed along the longitudinal axis, the opening configured to accommodate a cable, and at least one contact pressure feature running around a circumference of the cylinder, wherein the cylinder is split perpendicular to the flat ends into two halves.

A method according to one or more embodiments of the present disclosure includes providing a packer including: a cylinder of elastomer including: two flat ends; a longitudinal axis; an opening formed along the longitudinal axis; and at least one contact pressure feature running around a circumference of the cylinder, wherein the cylinder is split perpendicular to the flat ends into two halves; and installing the packer around a cable by disposing the cable in the opening.

A method according to one or more embodiments of the present disclosure includes installing a packer around a cable by disposing the cable in an opening formed along a longitudinal axis of the packer, wherein the packer further includes: a cylinder of elastomer including: two flat ends, wherein the cylinder is split perpendicular to the flat ends into two halves; and at least one contact pressure feature running around a circumference of the cylinder; mounting the packer to a top of a pressure control equipment stack; compressing the packer axially to increase a radial contact pressure between the elastomer and the cable; attaching a downhole tool to an end of the cable; lowering the downhole tool via the cable through the pressure control equipment stack, through a wellhead, and into a wellbore; and performing at least one operation in the wellbore using the cable.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein.

Figure 5A:
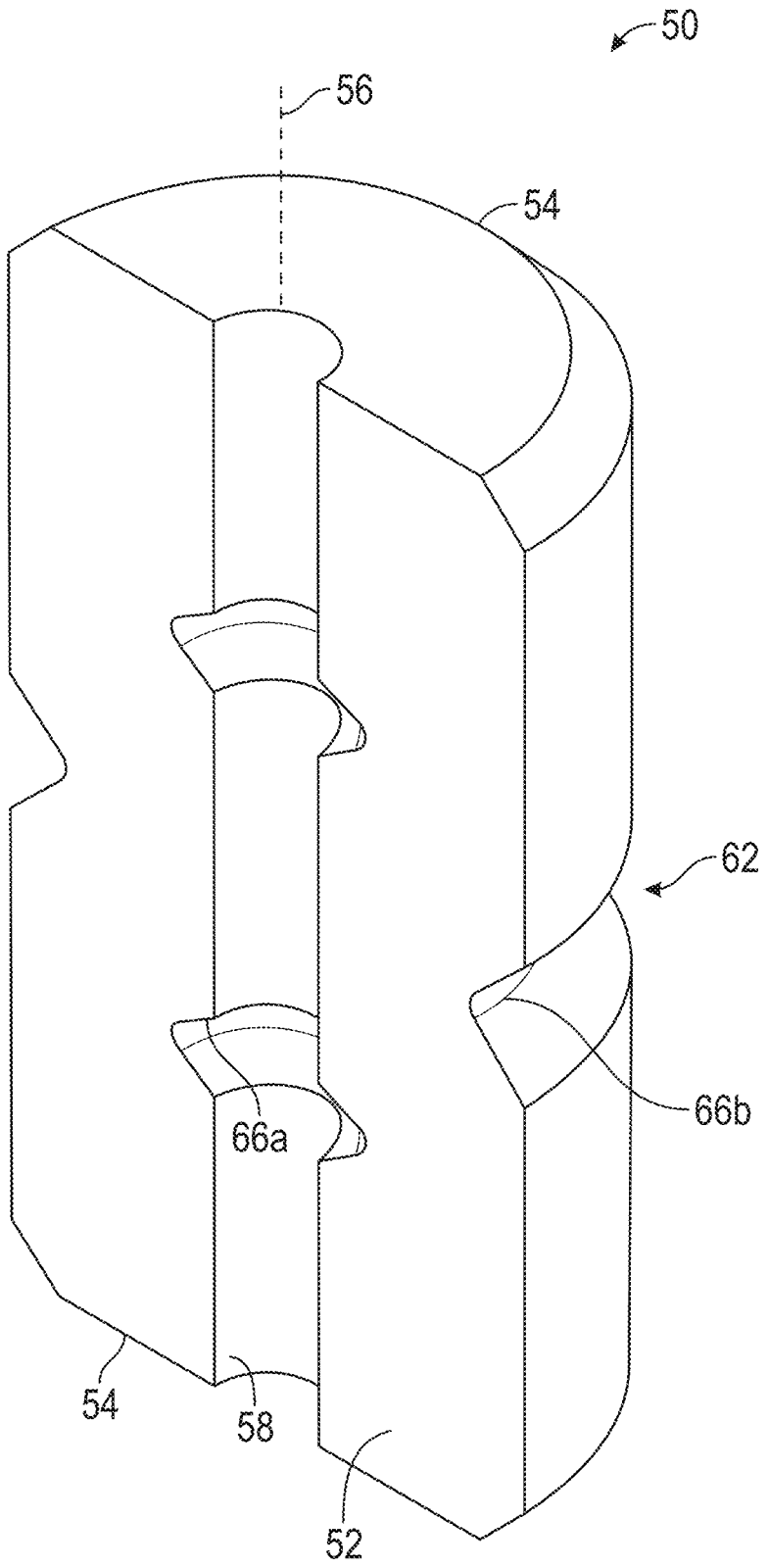
FIG. 5A shows a perspective view of one half of a dynamic sealing packer having grooves on the outer circumference and the inner circumference, according to one or more embodiments of the present disclosure.
Figure 5B:
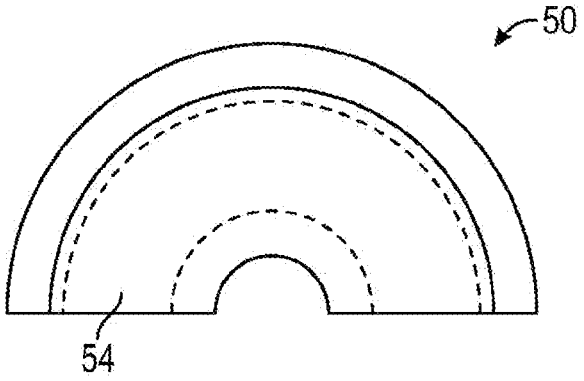
FIG. 5B shows a top view of the one half of the dynamic sealing packer shown in FIG. 5A, according to one or more embodiments of the present disclosure.
Figure 5C:
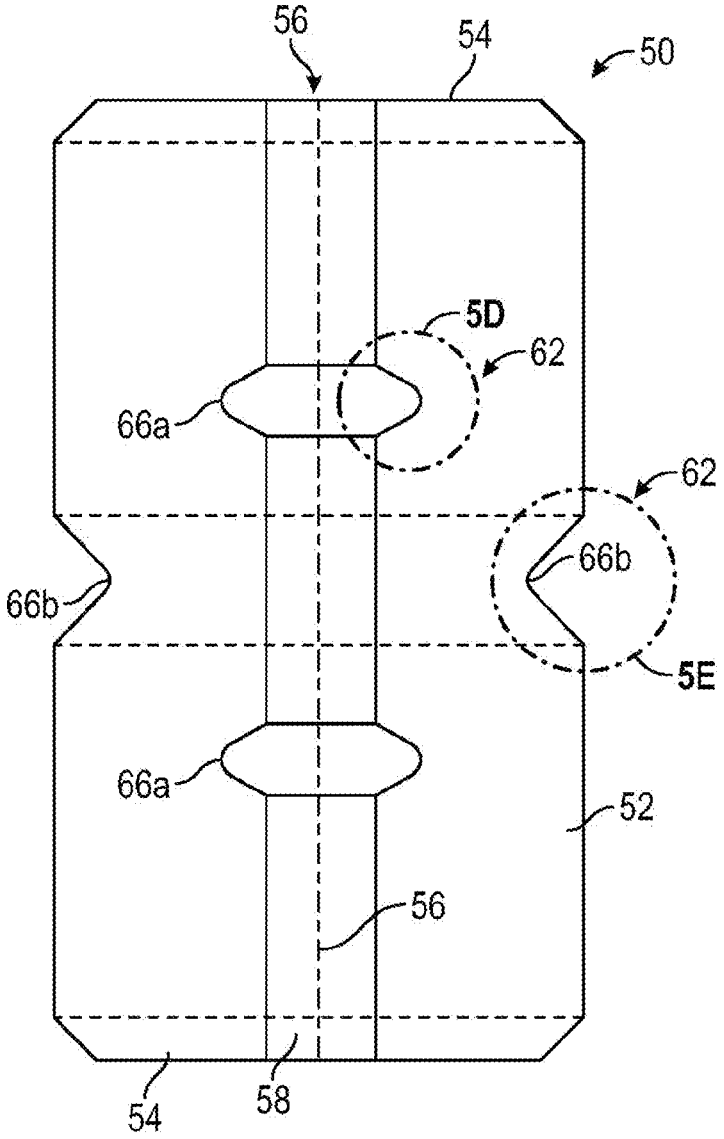
Figure 5D:
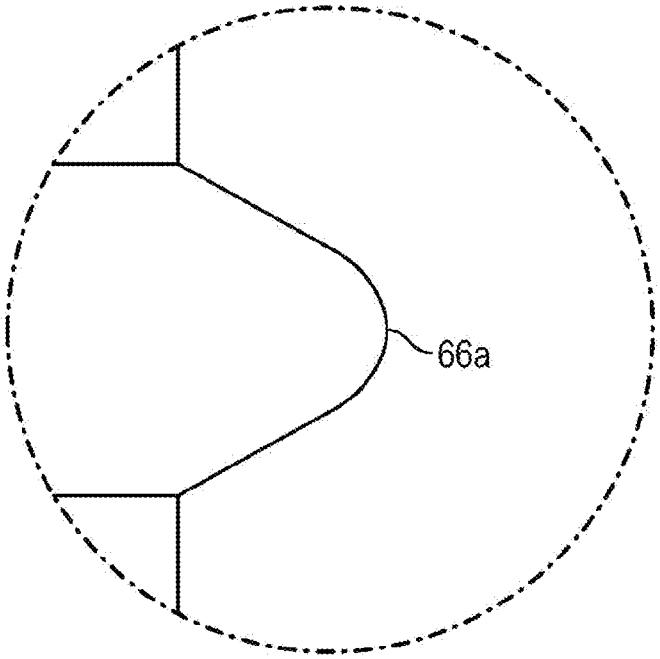
Figure 5E:
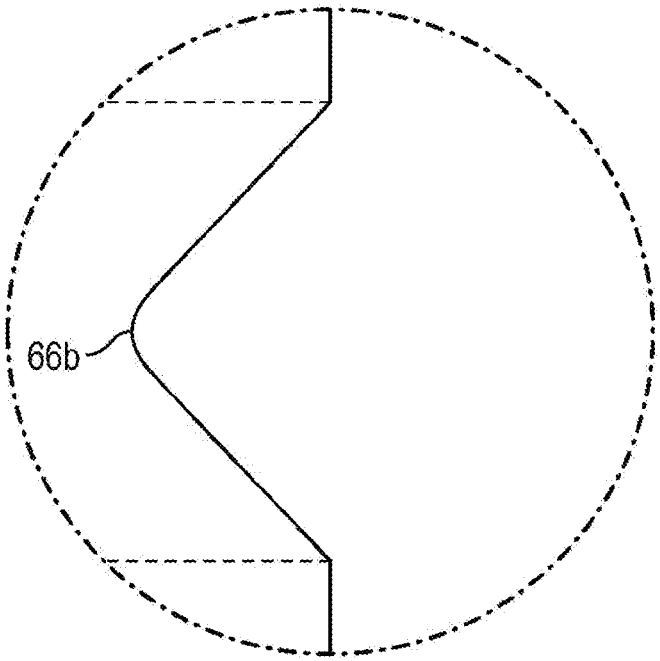

FIB. 5C shows a front view of the one half of the dynamic sealing packer shown in FIG. 5A, according to one or more embodiments of the present disclosure;

FIG. 5D shows detail of a groove on an inner circumference of the dynamic sealing packer at "5D" of FIG. 5C, according to one or more embodiments of the present disclosure; and FIG. 5E shows detail of a groove on the outer circumference of the dynamic sealing packer at "5E" of FIG. 5C, according to one or more embodiments of the present disclosure;

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims, the terms "connect," "connection," "connected," "in connection with," and "connecting," are used to mean "in direct connection with," in connection with via one or more elements." The terms "couple," "coupled," "coupled with," "coupled together," and "coupling" are used to mean "directly coupled together," or "coupled together via one or more elements." The term "set" is used to mean setting "one element" or "more than one element." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point at the surface from which drilling operations are initiated as being the top point and the total depth being the lowest point, wherein the well (e.g., wellbore, borehole) is vertical, horizontal, or slanted relative to the surface.

In general, embodiments of the present disclosure relate to wireline PCE systems and methods. Wireline PCE stacks are coupled to and/or positioned vertically above a wellhead during wireline operations in which a tool supported on a wireline is lowered through the wireline PCE stack to enable inspection and/or maintenance of a well, for example. The wireline PCE stack includes components that seal about the wireline or cable as it moves relative to the wireline PCE stack. The wireline PCE stack may isolate the environment, as well as other surface equipment, from pressurized fluid within the well. That is, the PCE employed during wireline operations is intended to contain pressure originated from the wellbore.

Figure 1:
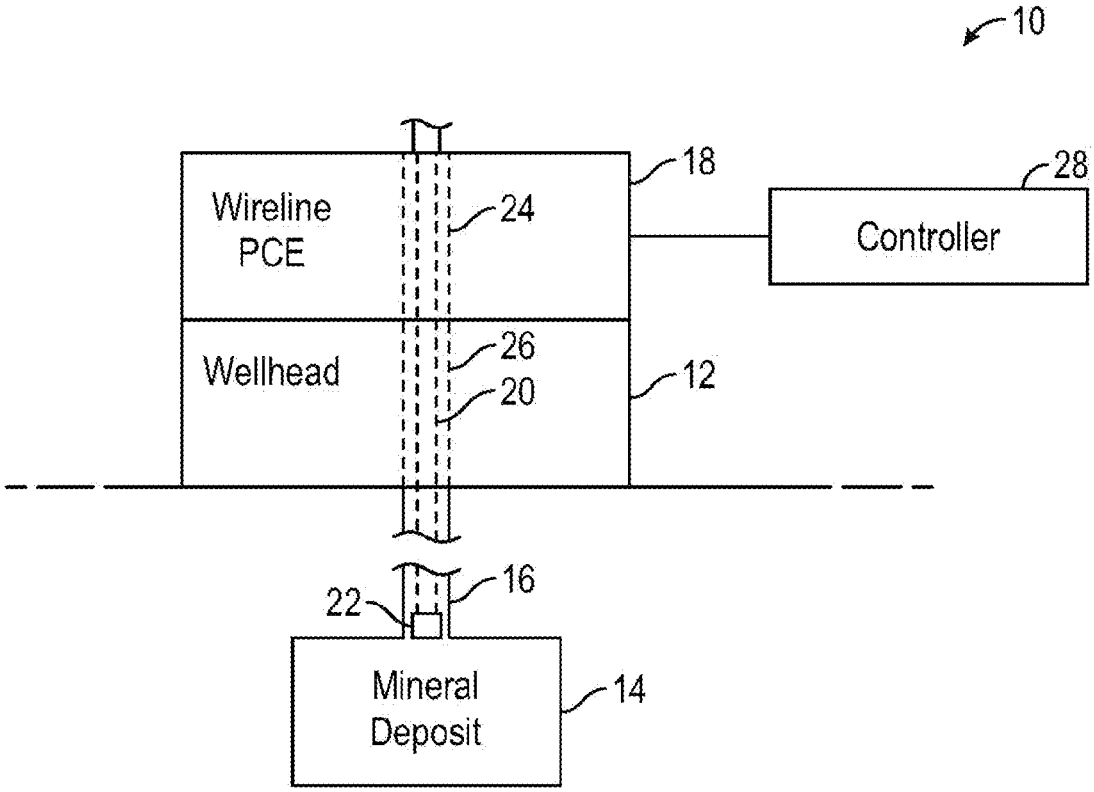
FIG. 1 shows a schematic diagram of a wireline intervention system, according to one or more embodiments of the present disclosure.

Referring now to FIG. 1, a schematic diagram of a wireline intervention system 10 according to one or more embodiments of the present disclosure is shown. The system 10 includes a wellhead 12, which is coupled to a mineral deposit 14 via a wellbore 16. The wellhead 12 may include any of a variety of other components such as a spool, a hanger, and a Christmas tree. According to one or more embodiments of the present disclosure, FIG. 1 shows a wireline PCE stack 18 coupled to the wellhead 12 to facilitate wireline operations, which are carried out by lowering a cable 20 (e.g., communication cable, wireline, slickline, or coiled tubing) and a tool 22 (e.g., configured to collect data about the mineral deposit 14 and/or the wellbore 16) through a bore 24 defined by the wireline PCE stack 18, through a bore 26 defined by the wellhead 12, and into the wellbore 16. As shown, a controller 28 (e.g., an electronic controller) is provided to control one or more components of the wireline PCE stack 18 via an electric actuator, for example.

Figure 2:
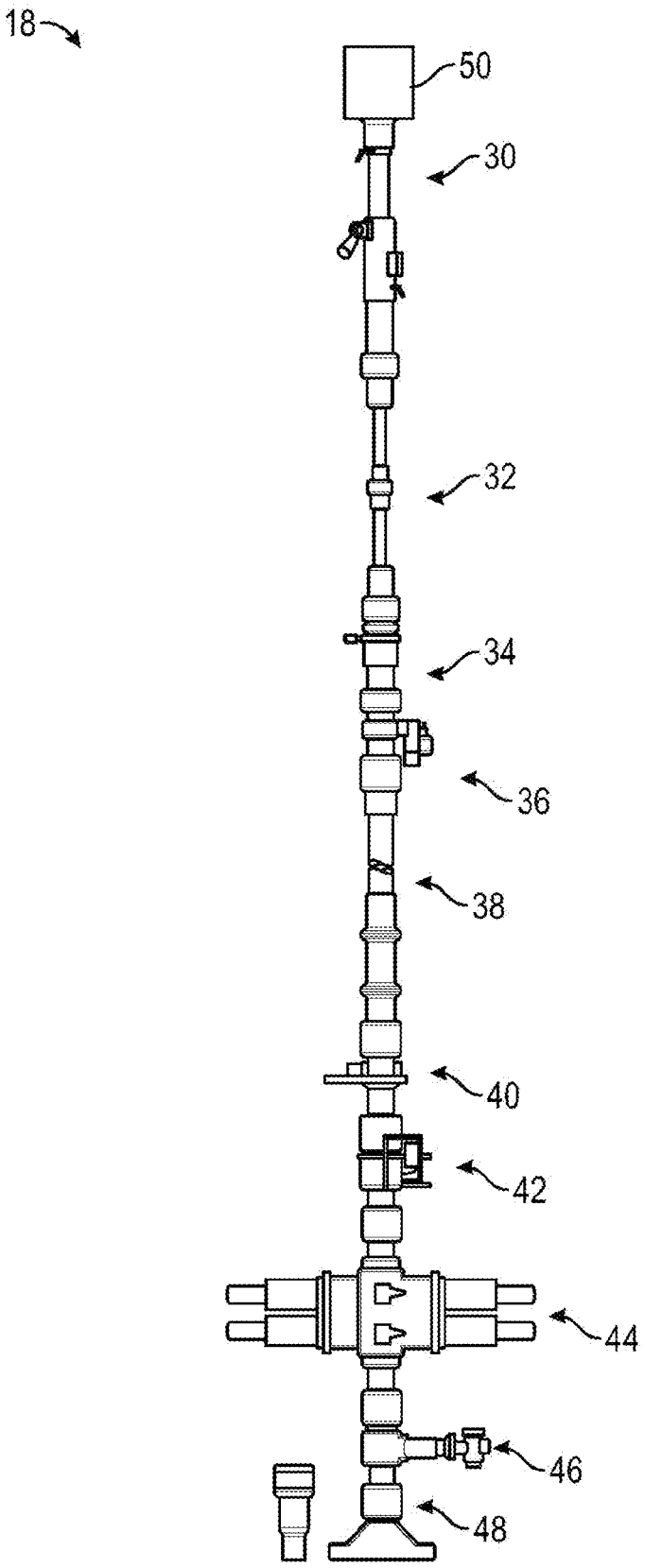
FIG. 2 shows a wireline PCE stack, according to one or more embodiments of the present disclosure.

Referring now to FIG. 2, a wireline PCE stack 18, according to one or more embodiments of the present disclosure is shown. As shown in FIG. 2, the wireline PCE stack 18 may include various components, such as a packoff/line wiper 30, a grease head 32, a head catcher 34, a chemical injection sub 36, a lubricator 38, a quick test sub 40, a tool trap 42, a wireline valve, such as a hydraulic blowout preventer 44, a pump-in-sub/flow T 46, and an adapter flange/swedge 48, for connecting to a wellhead 12, as previously described, for example. The wireline PCE stack 18 according to one or more embodiments of the present disclosure may include all of the components shown in FIG. 2, some of the components shown in FIG. 2, or one or more other components that facilitate wireline intervention operations that are not shown in FIG. 2, for example. According to one or more embodiments of the present disclosure, as previously described with respect to FIG. 1, a tool 22 attached to an end of a cable 20 may be lowered via the cable 20 through the wireline PCE stack 18, through the wellhead 12, and into the wellbore 16. Thereafter, at least one wireline intervention operation may be performed in the wellbore 16 using the cable 20. Examples of wireline intervention operations include any operation carried out on an oil and gas well to extend its producing life by improving performance, provide data to help manage the production rate of the well, shut off and safely abandon a flowing well, provide maintenance, or repair or replace downhole equipment.

Still referring to FIG. 2, a dynamic sealing packer 50 may be mounted at the top of the wireline PCE stack 18, where the cable 20 enters the equipment at the uppermost part of the packoff/line wiper 30. According to one or more embodiments of the present disclosure, the dynamic sealing packer 50 may be installed around the cable 20 by disposing the cable 20 in an opening formed along a longitudinal axis of the packer 50, as further described below.

Figure 3:
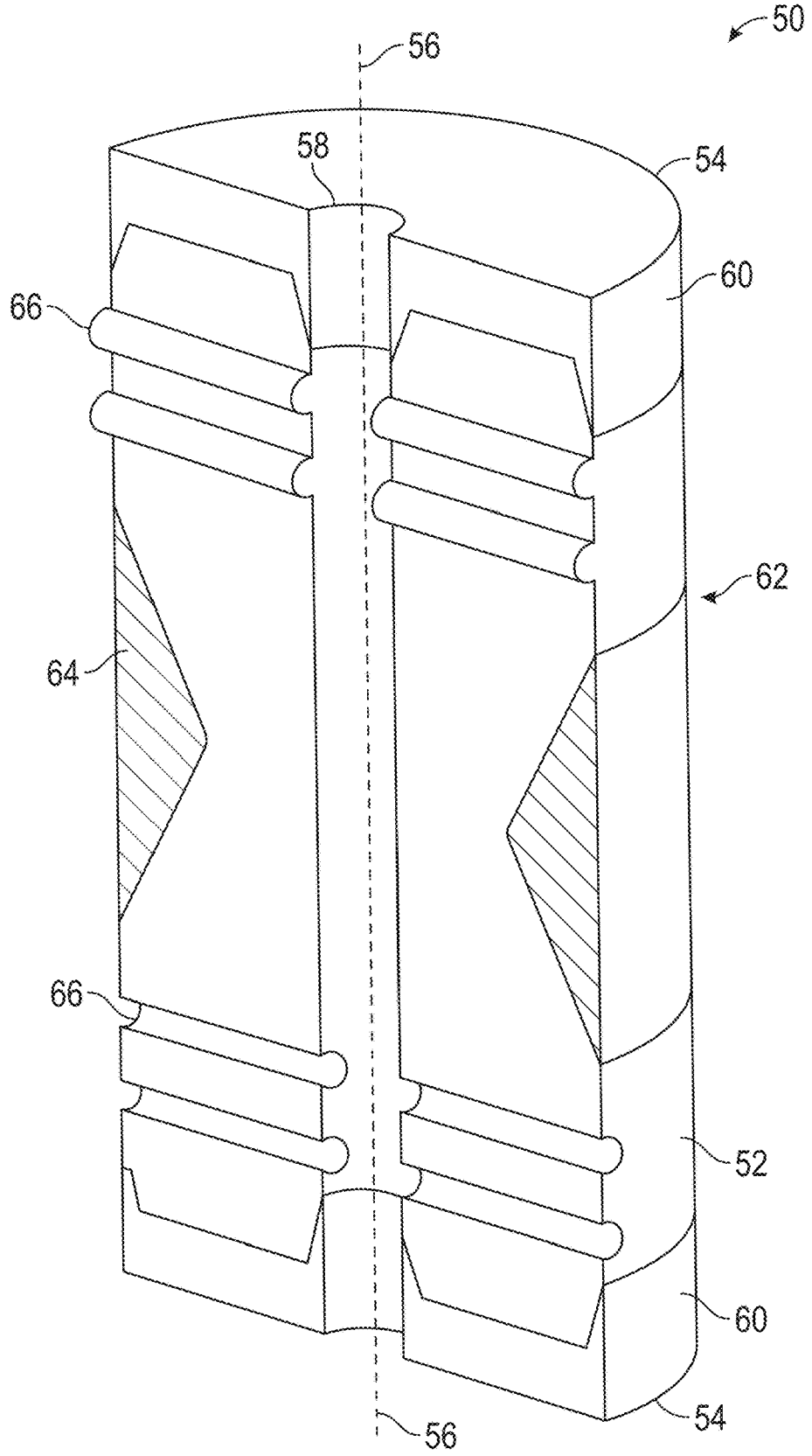
FIG. 3 shows one half of a dynamic sealing packer, according to one or more embodiments of the present disclosure.

Referring now to FIG. 3, one half of a dynamic sealing packer 50 is shown according to one or more embodiments of the present disclosure. That is, according to one or more embodiments of the present disclosure, the dynamic sealing packer 50 is a cylinder 52 having two flat ends 54 and a longitudinal axis 56. According to one or more embodiments of the present disclosure, the cylinder 52 of the dynamic sealing packer 50 is split perpendicular to the flat ends 54 of the cylinder 52, thereby creating two halves. FIG. 3 shows one of these two halves of the dynamic sealing packer 50, according to one or more embodiments of the present disclosure. As further shown in FIG. 3, the dynamic sealing packer 50 also includes an opening 58 formed along the longitudinal axis 56. According to one or more embodiments of the present disclosure, the opening 58 is configured to accommodate a cable 20 for wireline intervention operations, as previously described. Advantageously, splitting the dynamic sealing packer 50 into two halves facilitates installation of the dynamic sealing packer 50 around the cable 20.

Still referring to FIG. 3, the cylinder 52 of the dynamic sealing packer 50 may be made out of an elastomeric material, according to one or more embodiments of the present disclosure. As shown in FIG. 3, an end cap 60 may be disposed at each of the two flat ends 54 of the dynamic sealing packer 50, according to one or more embodiments of the present disclosure. The end caps 60 may be made out of a material different from the elastomeric material that the cylinder 52 is made out of, according to one or more embodiments of the present disclosure. For example, the end caps 60 may be made out of fabric, or out of a material having different material properties than the elastomeric material to prevent material loss and extrusion at the interface of the cable 20 and a piston of a component of the PCE stack 18, according to one or more embodiments of the present disclosure.

Still referring to FIG. 3, the dynamic sealing packer 50 according to one or more embodiments of the present disclosure includes at least one contact pressure feature 62 running around a circumference of the cylinder 52, according to one or more embodiments of the present disclosure. In the example shown in FIG. 3, the at least one contact pressure feature 62 may be a wedge-shaped energizing ring 64, for example, running around an outer circumference of the cylinder 52. According to one or more embodiments of the present disclosure, the wedge-shaped energizing ring 64 may be made out of metal or plastic, for example. As shown in FIG. 3, the energizing ring 64 includes a height that points inwardly toward the opening 58 at the center of the dynamic sealing packer 50. Because of this configuration of the energizing ring 64, when the elastomeric material of the cylinder 52 is compressed axially, the energizing ring 64 drives compression of the elastomeric material of the cylinder 52 radially, thereby raising the contact pressure between the elastomeric material and the cable 20. Increasing the contact pressure in this way improves the seal formed around the cable 20, thereby better preventing leakage of well contents during wireline operations. Additionally, driving compression of the elastomeric material of the cylinder 52 in this way radially reduces wear on the ends of the packer 50, and spreads out the contact pressure along the axial length of the packer 50 as the packer 50 makes contact with the cable 20.

Still referring to FIG. 3, the dynamic sealing packer 50 according to one or more embodiments of the present disclosure may also include an interlocking feature 66. According to one or more embodiments of the present disclosure, the interlocking feature 66 may include a series of bumps and grooves on each of the two halves of the cylinder 52. For example, a series of bumps and grooves on one half of the cylinder 52 may correspond with a series of grooves and bumps on the other half of the cylinder such that the series of bumps on either half of the cylinder 52 interlocks with the series of grooves on the other half of the cylinder 52. In this way, the interlocking feature 66 according to one or more embodiments of the present disclosure prevents leakage of well contents along the split seam of the cylinder 52.

Figure 4B:
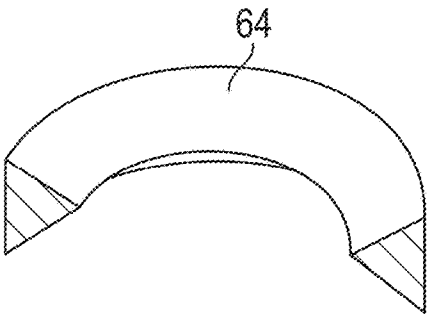
FIG. 4B shows an example of an energizing ring of a dynamic sealing packer according to one or more embodiments of the present disclosure.
Figure 4C:
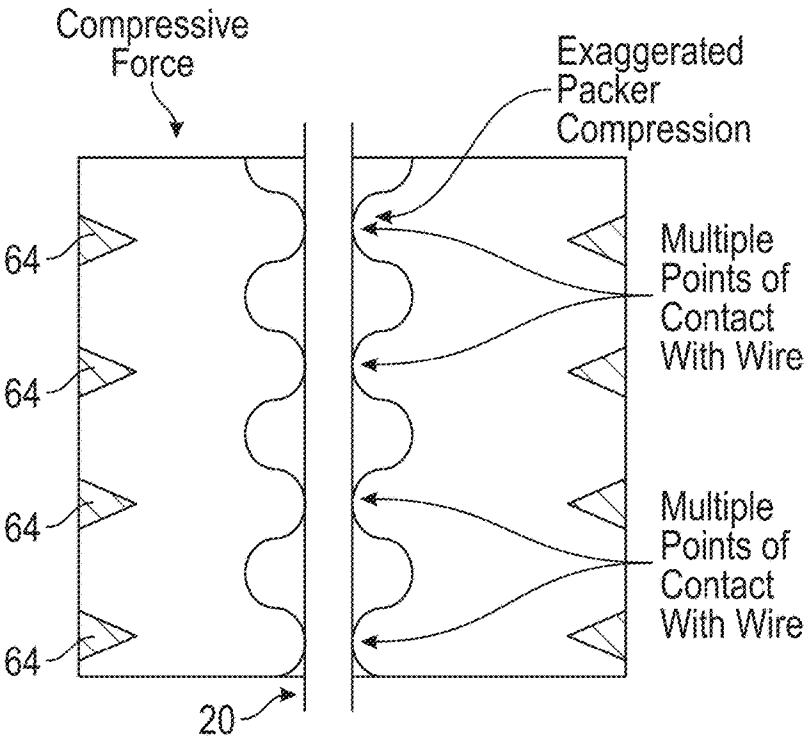
FIG. 4C shows a dynamic sealing packing having multiple energizing rings installed around a cable, according to one or more embodiments of the present disclosure.
Figure 4A:
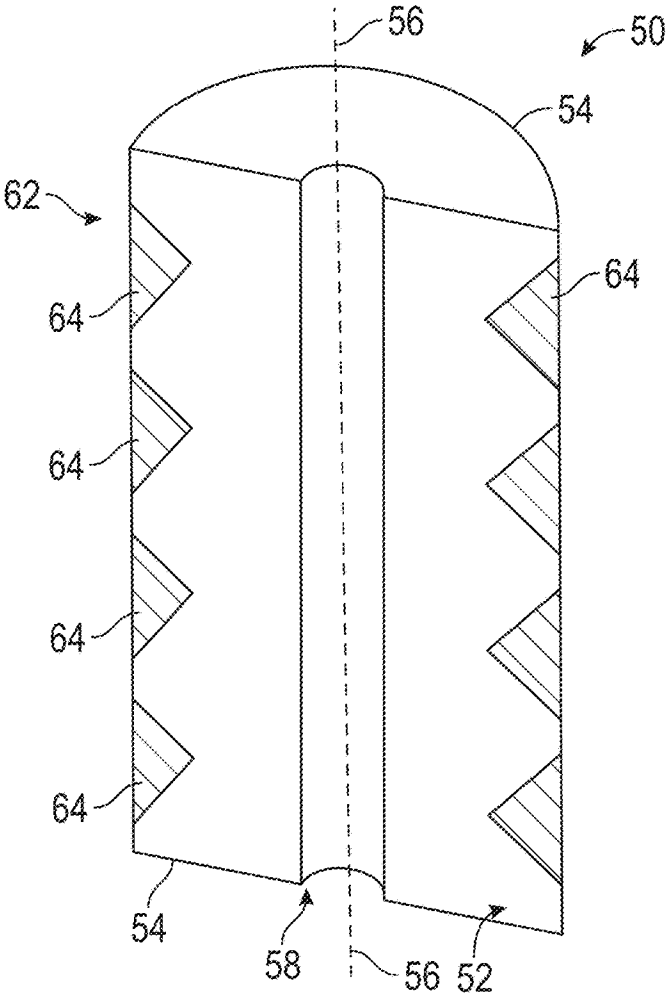
FIG. 4A shows one half of a dynamic sealing packer having multiple energizing rings, according to one or more embodiments of the present disclosure.

Referring now to FIG. 4A, one half of a dynamic sealing packer 50 according to one or more embodiments of the present disclosure is shown. That is, similar to the example shown in FIG. 3, the dynamic sealing packer 50 shown in FIG. 4A is a cylinder 52 having two flat ends 54 and a longitudinal axis 56. According to one or more embodiments of the present disclosure, the cylinder 52 of the dynamic sealing packer 50 is split perpendicular to the flat ends 54 of the cylinder 52, thereby creating two halves. FIG. 4A shows one of these two halves of the dynamic sealing packer 50, according to one or more embodiments of the present disclosure. As further shown in FIG. 4A, the dynamic sealing packer 50 also includes an opening 58 formed along the longitudinal axis 56. According to one or more embodiments of the present disclosure, the opening 58 is configured to accommodate a cable 20 for wireline intervention operations, as previously described. Advantageously, splitting the dynamic sealing packer 50 into two halves facilitates installation of the dynamic sealing packer 50 around the cable 20.

Still referring to FIG. 4A, the cylinder 52 of the dynamic sealing packer 50 may be made out of an elastomeric material, according to one or more embodiments of the present disclosure. As previously described with respect to FIG. 3, the dynamic sealing packer 50 of FIG. 4A may include end caps 60 disposed at the two flat ends 54 of the packer 50 made out of a material different than the elastomeric material, according to one or more embodiments of the present disclosure.

Still referring to FIG. 4A, the dynamic sealing packer 50 according to one or more embodiments of the present disclosure includes at least one contact pressure feature 62 running around a circumference of the cylinder 52, according to one or more embodiments of the present disclosure. In the example shown in FIG. 4A, the at least one contact pressure feature 62 may be a series of wedge-shaped energizing rings 64, for example, running around an outer circumference of the cylinder 52. FIG. 4B shows one of the wedge-shaped energizing rings 64 in isolation, for example. According to one or more embodiments of the present disclosure, the wedge-shaped energizing ring 64 may be made out of metal or plastic, for example. As shown in FIG. 4A, each energizing ring 64 of the series of energizing rings 64 includes a height that points inwardly toward the opening 58 at the center of the dynamic sealing packer 50. Because of this configuration of the series of energizing rings 64, when the elastomeric material of the cylinder 52 is compressed axially, the series of energizing rings 64 drives compression of the elastomeric material of the cylinder 52 radially, thereby raising the contact pressure between the elastomeric material and the cable 20, as shown in FIG. 4C, for example. Increasing the contact pressure in this way improves the seal formed around the cable 20, thereby preventing leakage of well contents during wireline operations. Additionally, driving compression of the elastomeric material of the cylinder 52 in this way radially reduces wear on the ends of the packer 50, and spreads out the contact pressure along the axial length of the packer 50 as the packer 50 makes contact with the cable 20.

Referring now to FIG. 5A, a perspective view of one half of a dynamic sealing packer 50 is shown, according to one or more embodiments of the present disclosure. That is, similar to the examples shown in FIGS. 3 and 4A, the dynamic sealing packer 50 shown in FIG. 5A is a cylinder 52 having two flat ends 54 and a longitudinal axis 56. According to one or more embodiments of the present disclosure, the cylinder 52 of the dynamic sealing packer 50 is split perpendicular to the flat ends 54 of the cylinder 52, thereby creating two halves. FIG. 5A shows one of these two halves of the dynamic sealing packer 50, according to one or more embodiments of the present disclosure. As further shown in FIG. 5A, the dynamic sealing packer 50 also includes an opening 58 formed along the longitudinal axis 56. According to one or more embodiments of the present disclosure, the opening 58 is configured to accommodate a cable 20 for wireline intervention operations, as previously described. Advantageously, splitting the dynamic sealing packer 50 into two halves facilitates installation of the dynamic sealing packer 50 around the cable 20.

Still referring to FIG. 5A, the cylinder 52 of the dynamic sealing packer 50 may be made out of an elastomeric material, according to one or more embodiments of the present disclosure. As previously described with respect to FIG. 3, the dynamic sealing packer of FIG. 5A may include end caps 60 disposed at the two flat ends 54 of the packer 50, and the end caps 60 may be made out of a material different than the elastomeric material, according to one or more embodiments of the present disclosure. FIG. 5B shows a top view of one of the flat ends 54 of the packer 50, according to one or more embodiments of the present disclosure, for example.

Referring back to FIG. 5A, the dynamic sealing packer 50 according to one or more embodiments of the present disclosure includes at least one contact pressure feature 62 running around a circumference of the cylinder 52, according to one or more embodiments of the present disclosure. In the example shown in FIG. 5A, the at least one contact pressure feature 62 may be at least one groove 66*a* running around an inner circumference of the cylinder 52 around the opening 58, according to one or more embodiments of the present disclosure. As further shown in FIG. 5A, the at least one contact pressure feature 62 may be at least one groove 66*b* running around an outer circumference of the cylinder 52, according to one or more embodiments of the present disclosure. The dynamic sealing packer 50 according to one or more embodiments of the present disclosure may include at least one groove 66*a* solely around the inner circumference of the cylinder 52, at least one groove 66*b* solely around the outer circumference of the cylinder, or the at least one groove 66*a* running around the inner circumference of the cylinder 52 and the at least one groove 66*b* running around the outer circumference of the cylinder 52 in combination. According to one or more embodiments of the present disclosure, one or both grooves 66*a*, 66*b* better distribute the radial load across the cable 20 as the packer 50 is compressed axially, for example. In this way, one or both grooves 66*a*, 66*b* increase radial contact pressure between the elastomer and the cable 20, thereby improving sealing of the packer 50 around the cable 20, according to one or more embodiments of the present disclosure.

Referring now to FIG. 5C, a front view of the one half of the dynamic sealing packer 50 shown in FIG. 5A is shown according to one or more embodiments of the present disclosure. Specifically, FIG. 5C provides a front view of the opening 58 formed along the longitudinal axis 56 for accommodating the cable 20 for wireline intervention operations, as previously described. FIG. 5C also provides a front view of the at least one contact pressure feature 62 shown in FIG. 5A, for example. Specifically, FIG. 5C shows the at least one groove 66*a* running around the inner circumference of the cylinder 52 around the opening 58, and the at least one groove 66*b* running around the outer circumference of the cylinder, according to one or more embodiments of the present disclosure.

Referring now to FIG. 5D, detail of the groove 66*a* on the inner circumference of the dynamic sealing packer 50 at "5D" of FIG. 5C is shown, according to one or more embodiments of the present disclosure. As shown in FIG. 5D, the groove 66*a* on the inner circumference of the cylinder 52 of the dynamic sealing packer 50 may assume an acute angle of approximately 60°, for example.

Referring now to FIG. 5E, detail of the groove 66*b* on the outer circumference of the dynamic sealing packer 50 at "5E" of FIG. 5C is shown, according to one or more embodiments of the present disclosure. As shown in FIG. 5E, the groove 66*b* on the outer circumference of the cylinder 52 of the dynamic sealing packer 50 may assume a right angle of approximately 90°, for example.

The dynamic sealing packer 50 according to one or more embodiments of the present disclosure may be machined or molded to assume a final shape, as described herein. According to one or more embodiments of the present disclosure, parts of the dynamic sealing packer 50 may be assembled loose or with adhesive. After the dynamic sealing packer 50 according to one or more embodiments of the present disclosure becomes worn such that it needs to be replaced, the two halves of the dynamic sealing packer 50 may facilitate replacement of the dynamic sealing packer 50 around the cable 20 in the field.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A packer comprising:
a cylinder of elastomer comprising:
two flat ends;
a longitudinal axis;
an opening formed along the longitudinal axis, the opening configured to accommodate a cable; and
at least one contact pressure feature running around a circumference of the cylinder, the at least one contact pressure feature comprising at least one energizing ring extending around an outer circumference of the cylinder,
wherein the cylinder is split perpendicular to the flat ends into two halves, and
wherein compressing the packer axially causes the at least one energizing ring to exert a radial contact pressure on the cylinder of elastomer.

2. The packer of claim 1, wherein the at least one contact pressure feature further comprises at least one groove running around the outer circumference of the cylinder.

3. The packer of claim 1,
wherein a radial thickness of the at least one energizing ring points inwardly toward the opening.

4. The packer of claim 3, further comprising an interlocking feature comprising a series of bumps and grooves on each of the two halves.

5. The packer of claim 1, further comprising an interlocking feature comprising a series of bumps and grooves on each of the two halves.

6. The packer of claim 1, further comprising an end cap disposed at each of the two flat ends, wherein the end caps are made of a material other than an elastomeric material.

7. The packer of claim 6, wherein the material of the two end caps has material properties different than the cylinder of elastomer.

8. A system comprising:
a stack for pressure control equipment;
a cable that enters the pressure control equipment; and
the packer of claim 1 installed around the cable,
wherein the packer is mounted at a top of the stack.

9. A method comprising:
providing a packer comprising:
a cylinder of elastomer comprising:
two flat ends;
a longitudinal axis;
an opening formed along the longitudinal axis; and
at least one contact pressure feature running around a circumference of the cylinder, wherein the at least one contact pressure feature comprises at least one energizing ring extending around an outer circumference of the cylinder, wherein the at least one energizing ring is coupled to the at least one contact pressure feature of the cylinder of elastomer such that the energizing ring exerts a radial contact
pressure on the cylinder of elastomer, and wherein the cylinder is split
perpendicular to the flat ends into two halves; and
installing the packer around a cable by disposing the cable in the opening.

10. The method of claim 9, further comprising:
mounting the packer to a top of a pressure control equipment stack.

11. The method of claim 10, further comprising:
compressing the packer axially to increase a radial contact pressure between the elastomer and the cable.

12. A method comprising:
installing a packer around a cable by disposing the cable in an opening formed along a longitudinal axis of the packer, wherein the packer further comprises:
a cylinder of elastomer comprising:

two flat ends, wherein the cylinder is split perpendicular to the flat ends into two halves; and at least one contact pressure feature running around a circumference of the cylinder, wherein the at least one contact pressure feature comprises at least one energizing ring extending around an outer circumference of the cylinder, and wherein the at least one energizing ring is coupled to the at least one contact pressure feature of the cylinder of elastomer such that the energizing ring exerts a radial contact pressure on the cylinder of elastomer;

mounting the packer to a top of a pressure control equipment stack;

compressing the packer axially to increase a radial contact pressure between the elastomer and the cable;

attaching a downhole tool to an end of the cable;

lowering the downhole tool via the cable through the pressure control equipment stack, through a wellhead, and into a wellbore; and performing at least one operation in the wellbore using the cable.

13. The method of claim 12, wherein the at least one contact pressure feature further comprises at least one groove running around the outer circumference of the cylinder.

14. The method of claim 12, wherein a radial thickness of the at least one energizing ring points inwardly toward the opening.

15. The method of claim 14, wherein the packer further comprises an interlocking feature comprising a series of bumps and grooves on each of the two halves.

16. The method of claim 12, wherein the packer further comprises an interlocking feature comprising a series of bumps and grooves on each of the two halves.

* * * * *